United States Patent [19]

Fleissner

[11] Patent Number: 4,770,313

[45] Date of Patent: Sep. 13, 1988

[54] ELEVATED CONTAINER FOR THE STORAGE OF SYNTHETIC FIBERS OR THE LIKE

[75] Inventor: Heinz Fleissner, Riehen, Switzerland

[73] Assignee: Fleissner GmbH & Co., Basel, Switzerland

[21] Appl. No.: 435,659

[22] Filed: Oct. 21, 1982

[30] Foreign Application Priority Data

Oct. 21, 1981 [DE] Fed. Rep. of Germany ..... 3141783

[51] Int. Cl.[4] ..... B65H 5/28

[52] U.S. Cl. ..... 220/72; 220/83

[58] Field of Search ..... 220/72, 1.5, 72.1, 83, 220/84

[56] References Cited

U.S. PATENT DOCUMENTS 2,596,881 5/1952 White ..... 220/72

3,027,044 3/1962 Winstead ..... 220/72

*Primary Examiner*—Henry J. Recla

*Assistant Examiner*—David Voorhees

*Attorney, Agent, or Firm*—Antonelli, Terry & Wands

[57] ABSTRACT

A lightweight container for storing synthetic fibers, liquids granular materials and the like above the level of the floor has a bottom wall and a plurality of upright side walls joined together and attached to the bottom wall. Each of the side walls is formed of sheet metal and is provided with horizontally arranged profiled portions extending in parallel to the bottom wall. In addition, the side walls have identical profiled portions which are spaced from the bottom wall in a corresponding arrangement so that the profiled portions mate or match around the periphery of the container.

14 Claims, 1 Drawing Sheet

ELEVATED CONTAINER FOR THE STORAGE OF SYNTHETIC FIBERS OR THE LIKE

The invention relates to an elevated container for storing, in particular, endless synthetic fibers, liquids, pasty or granular goods, and the like, consisting of a bottom and maximally upright walls attached thereto.

Containers of this type are necessary for receiving, intermediate storage, or merely transportation of all kinds of commodities. Depending on the usage, the containers must, in some instances, accommodate a large volume, on the one hand for the purpose of fully exploiting the space available in a room, on the other hand, for the purpose of avoiding repeated severing of the endless material to be stored, which must be performed correspondingly more frequently in case of smaller containers. This holds true, in particular, for endless synthetic fibers delivered continuously by the spinnerets which must, in certain cases, placed in intermediate storage directly after manufacture or after the drafting step. Any severing of the endless fibers is disadvantageous for the further treatment which in all cases is conducted continuously, so that also for this reason elevated containers are required having a large capacity.

When producing or constructing the large-scale containers, one must not only consider the fact that the walls must be rugged and must absorb the pressure acting from the inside toward the outside, for which purpose the walls, as is known, are provided with reinforcing ribs or rings, but also that the container are to have an only minor weight, because in the filled or empty state they must be routed along relatively large distances through the factory hangars, for example to convey the endless fibers stored therein to the next processing station. The conveying routes are predetermined in the hangars. Transportation takes place automatically with the aid of chain conveyors or the like, so that any kind of minimum weight is advantageous, not even considering the costs of material for the containers.

The invention is based on the object of constructing a portable elevated container which, in spite of its large internal volume, is fashioned to be relatively lightweight with respect to the wall portions and yet withstands the internal pressure caused by the filling. By means of an ingenious construction of the wall parts, a minimum weight can be achieved for the empty container, no matter which material is to be used for making the container.

Starting with the container discussed hereinabove, the invention provides, to attain the posed objective, that the walls are fashioned all around of a metal sheet or the like profiled in parallel to the bottom. In this connection, profiling should be of a zigzag shape in approximately such a way that the walls extend alternatingly into two planes oriented approximately in parallel to each other and joined together by webs. In other words, the metal sheet or the like is to consist of a trapezoidal box profile similar to sheet piling and oriented in parallel to the bottom.

Tests have shown that a wall having such a profiled configuration can absorb larger forces than in the case where the profiling extends at right angles to the bottom. In this connection, a special advantage resides in that it is thus possible to configure the wall parts at the respective level—as seen from the bottom—with a profiling corresponding respectively to the forces arising at this elevation, in such a way that only a minimum of material is used for construction, withstanding precisely the forces maximally arising at that point. Thus, a special feature of the invention is that there is not only the provision that the width of the outer and inner wall parts, extending approximately in parallel to each other, increases with the height of the container, which is explainable insofar as the forces acting from the inside toward the outside increase in proportion with the depth of the container, but also, additionally, the wall parts arranged on the inside of the container can be made to be smaller in height than the adjacent parts on the outside.

Thus, a particular advantage of the construction according to this invention resides in that the outer wall parts can be fashioned larger in width than the adjacent inner wall part disposed thereabove, which actually should be wider, because the existing bending and compressive forces decrease toward the upper rim of the container. On account of the idea of this invention, the outer wall parts can now be made longer in a specific proportion than corresponds to the actual calculation based on the forces respectively occurring at this level. The result is a reduction in necessary alternating profiling, with a substantial saving in material.

In a bilaterally fixedly clamped girder with a line load, the following equation is governing for the stress present in the material:

$$\sigma = B \cdot p \cdot \frac{b^2}{h^2}$$

wherein $\sigma$ stands for the permissible and/or measured stress in the material, p stands for the internal pressure in dependence on the depth in the container, B stands for a coefficient relating to the ratio between length and width of the wall part, b stands for the breadth of an inner or outer wall part, and h stands for the thickness of the metal sheet used.

It is possible by means of this equation to calculate, with a given stress $\sigma$, the respective breadth $$= \sqrt{\frac{\sigma \cdot h^2}{B \cdot p}}$$

with the pressure p varying with the respective height. It was found that the measured stress as compared with the calculated stress in the outer wall parts is lower by a factor C ranging between 1.2 and 1.8. On the basis of this fact, it is permissible to widen the outer wall parts by a factor of $\sqrt{1.2}$ to $\sqrt{1.8}$.

The low weight of the elevated container of this invention thus is due to the fact, on the one hand, that the weight of the container will be at a minimum, depending on the material employed, which latter, of course, is of importance for the absolute container weight on account of the respective specific gravity; this is so, because the walls need not be made with a great wall thickness; rather, the wall parts can withstand the occurring forces due to their profiling. Therefore, the walls do not exhibit any special reinforcing rings mounted to the outside and thus not coming into contact with the filled-in material; rather, the walls consist only of this profiled sheet metal or the like. On the other hand, the low weight of the container lies in the elongation of the profiling in dependence on the pressure respectively acting from the inside toward the outside, and finally in the overproportional change in the breadth of the outer wall parts due to the buckling and compressive stresses which are partially compensated therein.

The containers are suitably of a quadrangular design because the space available in a factory building can thus be optimally utilized. The corners, in this case, are constituted by angle profiles, suitably rectangular pipes, to which the profiled wall parts, depending on the material, are welded or otherwise connected.

The drawing shows one embodiment of the elevated container according to the invention. Still further details of the invention, which are also of significance in combination, will be explained below with reference to this drawing wherein.

Figure 1:
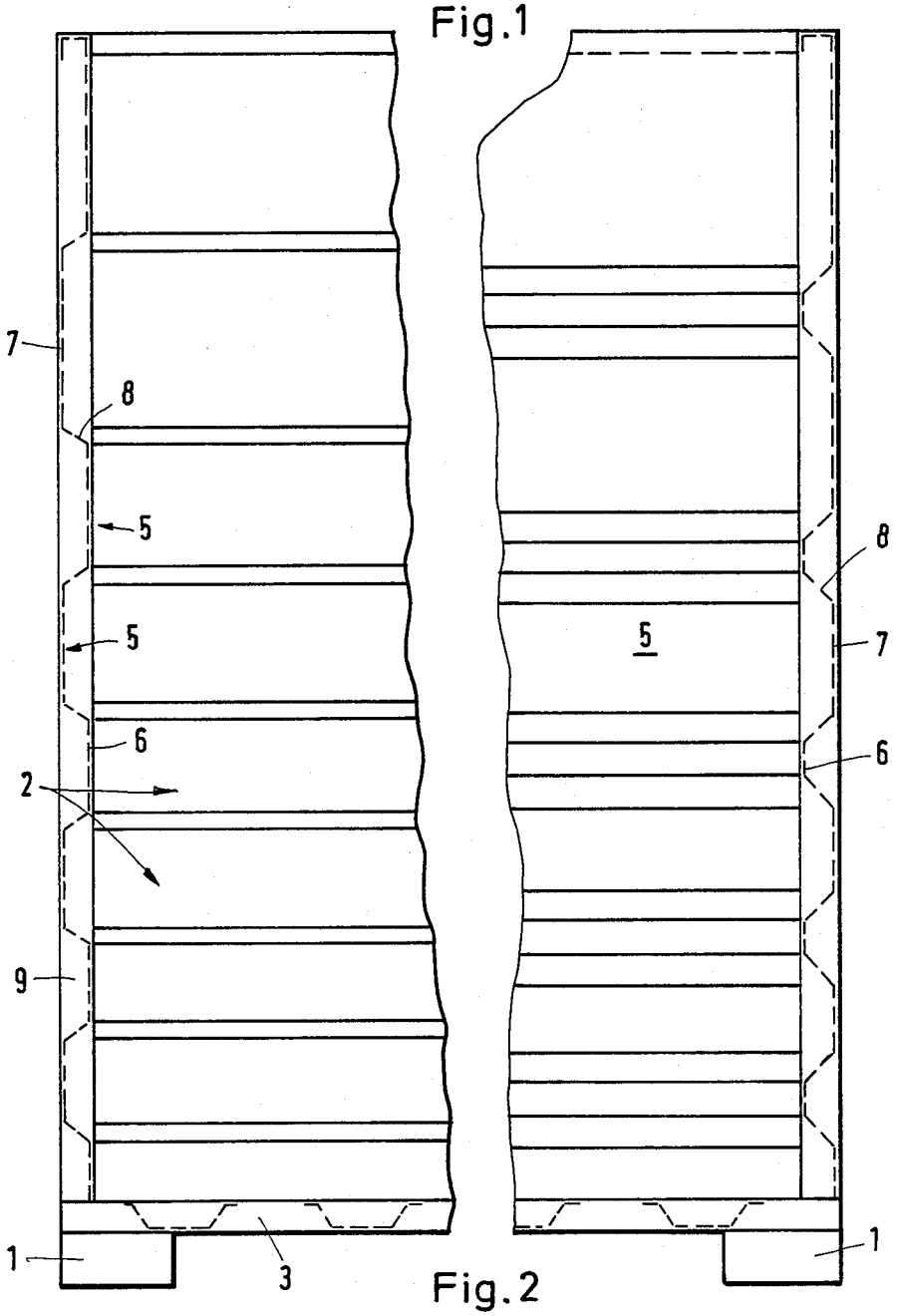
FIG. 1 shows an elevational view of an elevated container.

The container, standing on four feet 1, is denoted by 2 in its entirety. The container consists of a rectangular bottom 3 and four sidewalls made of a horizontally profiled sheet metal. The profiling extends in zigzag shape according to FIG. 1 in a kind of trapezoidal box profile. The breadth of the inner and outer wall parts increases from the bottom to the top in the left part of FIG. 1, due to the internally acting forces which decrease from the bottom toward the top. In this connection, it is to be noted that the inner wall parts 6, in proportion to the directly adjacent outer wall parts 7 disposed therebelow, are made to be smaller in width, i.e. the outer wall parts 7 are respectively broader than corresponds to the forces arising from the inside. In this case, the fact is utilized that the forces arising in the walls are partially compensated on the outer wall parts, namely, for example, the compressive stress against the buckling stress. It has been found that the outer wall parts adjacent respectively in the upward direction can be fashioned, in the zone of the container bottom, to be wider by approximately a factor of 1.1 to 1.13, without the occurring forces exceeding the permissible material stress. The correction factor effective here in the respective calculation of the width of the inner and outer wall parts varies with the height of the container. Thus, for example, a correction factor of even 1.38 can be used in the upper zone, causing a more vigorous elongation of the profiling in the upward direction. Thus, this elongation is independent of the fact which takes place anyway on account of the decreasing pressure stress in the upward direction.

The right-hand portion of FIG. 1 illustrates another example wherein the change of the inner wall parts 6 was omitted for reasons of strength technology. The outer wall parts 7 increase—as seen from the bottom—in dependence on the internal pressure, which decreases in the upward direction, and under consideration of factor C. Although, in this example, the changes in the bends of the sheet metal are larger with the height remaining the same, which renders this example less favorable, yet the manufacture is considerably simplified since four bending processes can be performed simultaneously on the bending press and thus the sheet metal need not be turned, either.

The profiling can be produced as desired. It can be stamped or bent. Casting of the walls is likewise possible, which would be advantageous, for example, in case of synthetic resin. The webs 8 between the outer and inner wall parts should be turned approximately by an angle of 45°–60° C. It can be seen from the drawing that the profiled walls do not merely serve for rigidifying of an inner wall, for example, but rather constitute the walls proper. Therefore, the profiling can be seen from the inside as well as from the outside.

Figure 2:
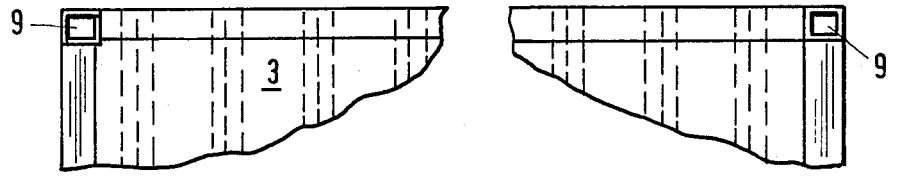
FIG. 2 shows a plan view of the device of FIG. 1.

According to FIG. 2, rectangular pipes 9 are arranged at the corners, the edges of the two vertically abutting sidewalls being welded thereto. It is also possible to make this rectangular profile of merely one profile exhibiting two legs joined at a right angle, the opening of this profile pointing toward the outside.

I claim:

1. A lightweight elevated container for storing endless synthetic fibers, liquids, pasty or granular goods and the like, which comprises a bottom wall and a plurality of upright side walls joined together and attached to the bottom wall, each of said side walls being formed of sheet metal and being provided with horizontal profiled portions extending in parallel to the bottom wall, said side walls having identical profiled portions which are spaced from the bottom wall in a corresponding arrangement, each side wall has inner and outer wall parts that extend alternatively into two planes and are connected by webs, said inner and outer parts being oriented approximately in parallel to each other, the width of the outer wall parts extending in the same plane increase successively above the bottom wall along the height of the container, and wherein the inner wall parts arranged towards the inside of the container are smaller in width than the adjacent outer parts on the outer side of the container.

2. A container according to claim 1, wherein the webs are aligned obliquely to the inner and outer wall parts.

3. A container according to claim 1, wherein the webs are joined to the inner and outer wall parts approximately at an angle of 60°.

4. A container according to claim 1, wherein the width of the outer and inner wall parts extending in parallel to each other increases successfully from the bottom wall along the height of the container.

5. A container according to claim 1, wherein the width of the inner wall parts extending in the same plane increases successfully from the bottom wall along the height of the container.

6. A container according to claim 1, wherein the outer wall part becomes larger in width than an adjacent inner wall part by a factor ranging from 1.1–1.4.

7. A container according to claim 6, wherein the factor increases with the height of the side wall.

8. A container according to claim 1, wherein said container has a quadrangular shape in horizontal cross-section and is provided with connecting columns at each of the four corners for joining the side walls together.

9. A container according to claim 8, wherein the connecting columns are outwardly open angle elements.

10. A container according to claim 8, wherein the connecting columns are rectangular pipes.

11. A container according to claim 8, wherein the plurality of side walls are welded to the connecting columns.

12. A container according to claim 1, wherein the inner wall parts remain constant in width while the outer wall parts increase in width in dependence on the decreasing internal pressure derived from the contents of the container.

13. A lightweight elevated container for storing endless synthetic fibers, liquids, pasty or granular goods and the like, which comprises a bottom wall and a plurality of upright side walls joined together and attached to the bottom wall, each of said side walls being formed of sheet metal and being provided with horizontal profiled portions extending in parallel to the bottom wall, said side walls having identical profiled portions which are spaced from the bottom wall in a corresponding arrangement, each side wall has inner and outer wall parts that extend alternatively into two planes and are connected by webs, said inner and outer parts being oriented approximately in parallel to each other, the width of the outer wall parts extending in the same plane increases successively above the bottom wall along the height of the container, and wherein the outer wall part is larger in width than the adjacent inner wall part disposed thereabove.

14. A lightweight elevated container for storing endless synthetic fibers, liquids, pasty or granular goods and the like, which comprises a bottom wall and a plurality of upright side walls joined together and attached to the bottom wall, each of said side walls being formed of sheet metal and being provided with horizontal profiled portions extending in parallel to the bottom wall, said side walls having identical profiled portions which are spaced from the bottom wall in a corresponding arrangement, a width of outer wall parts extending in the same plane increases successively above the bottom wall along the height of the container, and wherein each successive outer wall part is larger in width by a factor of $\sqrt{1.2}$ to $\sqrt{1.8}$, which is based on a linear load, with the internal pressure p in the container varying with the respective height of the container.

* * * * *